US010461438B2

(12) United States Patent
Shen et al.

(10) Patent No.: US 10,461,438 B2
(45) Date of Patent: Oct. 29, 2019

(54) WIDEBAND MULTI-LEVEL ANTENNA ELEMENT AND ANTENNA ARRAY

(71) Applicant: Communication Components Antenna Inc., Kanata (CA)

(72) Inventors: Lin-Ping Shen, Kanata (CA); Hua Wang, Kanata (CA); Willi Manfred Lotz, Kanata (CA); Minya M. Gavrilovic, Kanata (CA)

(73) Assignee: Communication Components Antenna Inc., Kanata (CA)

( * ) Notice: Subject to any disclaimer, the term of this patent is extended or adjusted under 35 U.S.C. 154(b) by 220 days.

(21) Appl. No.: 15/444,623

(22) Filed: Feb. 28, 2017

(65) Prior Publication Data

US 2017/0271780 A1 Sep. 21, 2017

Related U.S. Application Data

(60) Provisional application No. 62/309,844, filed on Mar. 17, 2016.

(51) Int. Cl.

| | |
|---|---|
| ***H01Q 21/06*** | (2006.01) |
| ***H01Q 1/48*** | (2006.01) |
| ***H01Q 1/52*** | (2006.01) |
| ***H01Q 21/24*** | (2006.01) |
| ***H01Q 1/24*** | (2006.01) |
| ***H01Q 3/34*** | (2006.01) |
| ***H01Q 9/04*** | (2006.01) |

(52) U.S. Cl.

CPC ..... *H01Q 21/065* (2013.01); *H01Q 1/246* (2013.01); *H01Q 1/48* (2013.01); *H01Q 1/523* (2013.01); *H01Q 3/34* (2013.01); *H01Q 9/0414* (2013.01); *H01Q 9/0457* (2013.01); *H01Q 21/24* (2013.01)

(58) Field of Classification Search

CPC ..... H01Q 21/065; H01Q 1/246; H01Q 1/48; H01Q 1/523; H01Q 3/34; H01Q 9/0414; H01Q 9/0457; H01Q 21/24

See application file for complete search history.

(56) References Cited

U.S. PATENT DOCUMENTS

| | | | | |
|---|---|---|---|---|
| 3,255,450 A | | 6/1966 | Butler | |
| 4,638,317 A | | 1/1987 | Evans | |
| 6,054,953 A | * | 4/2000 | Lindmark | H01Q 1/38 343/700 MS |

(Continued)

OTHER PUBLICATIONS

Pozar, David M. "Microstrip antenna aperture-coupled to a microstripline." Electronics letters 21.2 (1985): 49-50.

(Continued)

*Primary Examiner* — Dameon E Levi
*Assistant Examiner* — David E Lotter
(74) *Attorney, Agent, or Firm* — Sofer & Haroun, LLP

(57) ABSTRACT

Systems, methods, and devices relating to an antenna element and to an antenna array. A three level antenna element provides wideband coverage as well as dual polarization. Each of the three levels is a substrate with a conductive patch with the bottom level being spaced apart from the ground plane. Each of the three levels is spaced apart from the other levels with the spacings being non-uniform. The antenna element may be slot coupled by way of a cross slot in the ground plane. The antenna element, when used in an antenna array, may be surrounded by a metallic fence to heighten isolation from other antenna elements.

19 Claims, 17 Drawing Sheets

(56) References Cited

U.S. PATENT DOCUMENTS

| | | | | |
|---|---|---|---|---|
| 6,252,560 | B1 | 6/2001 | Tanaka et al. | |
| 8,077,093 | B2 | 12/2011 | Dean | |
| 8,704,727 | B2 | 4/2014 | Cruz et al. | |
| 8,803,757 | B2 | 8/2014 | Shen et al. | |
| 2012/0133549 | A1* | 5/2012 | Culkin | G01S 13/4463 342/195 |
| 2016/0190704 | A1* | 6/2016 | Celik | H01Q 5/0086 343/700 MS |
| 2016/0261047 | A1* | 9/2016 | Wallace | H01Q 5/335 |
| 2017/0331192 | A1* | 11/2017 | Yang | H01Q 9/0414 |
| 2017/0346181 | A1* | 11/2017 | Hojjat | H01Q 3/26 |
| 2018/0301801 | A1* | 10/2018 | Hojjat | H01Q 9/285 |

OTHER PUBLICATIONS

Wang, J., et al. "Multifunctional aperture coupled stack patch antenna." Electronics letters 26.25 (1990): 2067-2068.

* cited by examiner

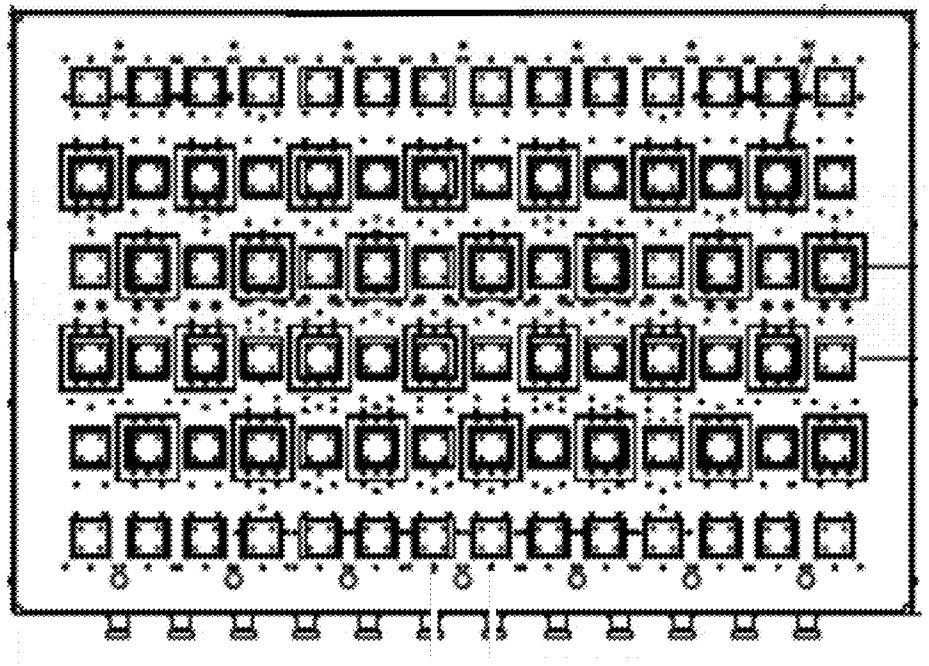
1
2
3
4
5
6
7
8
9
10
11
12
13
14
15
16
17
18
19
20
21
22
23
24
25
26
27
28
29
30
31
32
33
34
35
36
37
38
39
40
41

WIDEBAND MULTI-LEVEL ANTENNA ELEMENT AND ANTENNA ARRAY

TECHNICAL FIELD

The present invention relates to antennas. More specifically, the present invention relates to a multi-level antenna element which may be used in an antenna array.

BACKGROUND

The communications revolution of the late 20th century and of the early 21st century has given rise to the ubiquity of wireless devices. Nowadays mobile handsets, tablets, and other devices are able to communicate with each other by means of wireless signals. To this end, the frequency spectrum required for such communications can be quite broad and, to service such devices, antennas with a broad frequency range are needed. Specifically, it would be preferred if a single antenna system could service the frequency range of between 1690-2700 MHz.

While current systems have been known to perform adequately, usually by splitting the desired frequency range into two ranges, this approach tends to double the costs. Having one antenna system for the 1690-2360 MHz frequencies and having another antenna system for the 2360-2700 MHz frequencies, while it achieves the desired result, is expensive as two separate antenna systems are required.

There is therefore a need for an antenna system and for antenna components which can service the whole desired frequency range of between 1690-2700 MHz.

SUMMARY

The present invention provides systems, methods, and devices relating to an antenna element and to an antenna array. A three level antenna element provides wideband coverage as well as dual polarization. Each of the three levels is a substrate with a conductive patch with the bottom level being spaced apart from the ground plane. Each of the three levels is spaced apart from the other levels with the spacings being non-uniform. The antenna element may be slot coupled by way of a cross slot in the ground plane. The antenna element, when used in an antenna array, may be surrounded by a metallic fence to heighten isolation from other antenna elements.

In a first aspect, the present invention provides an antenna element comprising:

a first conductive patch on a first plane;

a second conductive patch on a second plane, said second patch being spaced apart from said first patch;

a third conductive patch on a third plane, said third patch being spaced apart from said second patch such that said second patch is between said first patch and said third patch;

wherein said first patch is spaced apart from a ground plane such that said first patch is between said ground plane and said second patch; and said antenna element receives a signal feed by way of a slot in said ground plane;

said first, second, and third planes are parallel to each other and to said ground plane.

In a second aspect, the present invention provides an antenna array comprising a plurality of antenna elements, at least one of said antenna elements comprising:

a first conductive patch on a first plane;

a second conductive patch on a second plane, said second patch being spaced apart from said first patch;

a third conductive patch on a third plane, said third patch being spaced apart from said second patch such that said second patch is between said first patch and said third patch;

wherein said first patch is spaced apart from a ground plane such that said first patch is between said ground plane and said second patch; and said antenna element receives a signal feed by way of a slot in said ground plane;

said first, second, and third planes are parallel to each other and to said ground plane.

BRIEF DESCRIPTION OF THE DRAWINGS

The embodiments of the present invention will now be described by reference to the following figures, in which identical reference numerals in different figures indicate identical elements and in which:

FIG. 3 is a top view of an antenna array according to another aspect of the invention;

DETAILED DESCRIPTION

Figure 1:
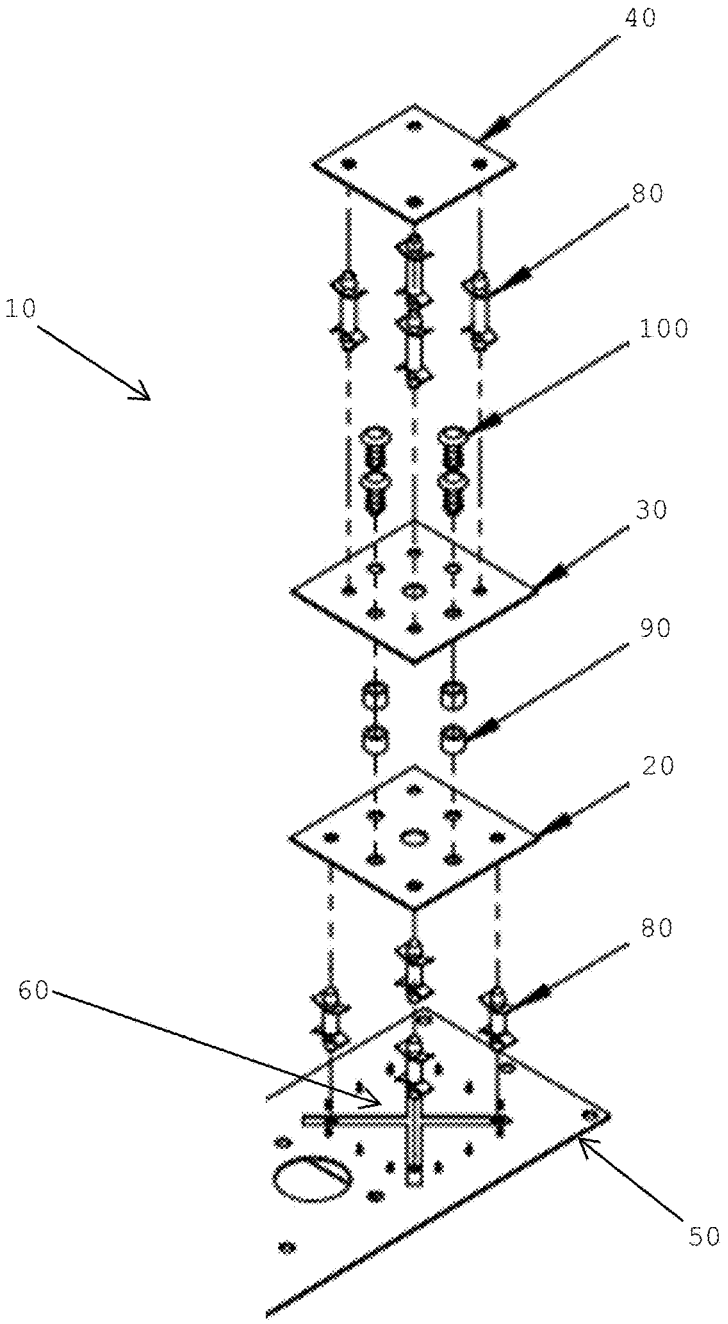
FIG. 1 is an exploded view of a multi-level antenna element according to one aspect of the invention.

Referring to FIG. 1, an exploded view of a multi-level antenna element according to one aspect of the invention is illustrated. The antenna element 10 includes patches on three levels, a first patch level 20, a second patch level 30, and a third patch level 40. Each of the levels is spaced apart (vertically in the figure) from the other levels. The first patch level 20 is spaced apart from a ground plane 50 on which the antenna element 10 is mounted. Also shown is a cross-slot 60 that is used to feed the antenna element 10.

Regarding implementation, any of the patch levels 20, 30, 40 may be equipped with a conductive patch which covers a portion of the underlying substrate or the whole substrate on the patch level may be either completely covered by its conductive patch or may be a conductive patch itself. It should be noted that, depending on the implementation, a substrate may not be necessary as the patch itself can constitute the level. The substrate may be a PCB (printed circuit board) or any other suitable substrate to hold the conductive patch. Alternatively, each of the patches may be a single metal plate that operates as the complete patch.

It should be clear that each of the patches on the three levels is a two dimensional conductive patch. Each patch is on a specific plane that is parallel to the planes containing the other patches. As well, all three planes containing the first, second, and third conductive patches are all parallel to the ground plane.

In the implementation illustrated in FIG. 1, each one of the patch levels is constructed from an aluminum plate that operates as the patch. Alternatively, the various patch levels may be constructed from a printed circuit board (PCB) with a conductive patch in any side (or both sides) of the PCB. Regardless of the implementation of the conductive patch, the conductive patch may have a shape that is circular, square, or any other shape that a person skilled in the art may understand to be suitable. As yet another alternative, instead of a PCB with a conductive patch, any of the patch levels may be constructed from a substrate with a high dielectric constant with a suitable conductive patch deposited on the surface of the substrate.

In the implementation illustrated in FIG. 1, each of the three patch levels is constructed from a single piece of conductive material. For this implementation, each patch level is constructed from a single piece of 0.8 mm thick aluminum plate.

To support the third level and to keep the levels at a constant and specific distance from each other, suitable supports 80 may be used. Of course, such supports are non-conductive and serve to support and lock the various patch levels in place. As can be seen, such supports are used between the ground plane and the first patch level and between the second and third patch levels. To support and lock the first patch level to the second patch level, spacers 90 and bolts 100 may be used. Such bolts and spacers are, again, non-conductive. Other supports and means of spacing the various levels apart may, of course, be used.

It should be noted that the first distance a between the first and second patch levels is different from the second distance b separating the second and the third patch levels. The third distance c between the ground plane and the first patch level is also different from both the first and second distances a and b. In one implementation, the distance a between the first and second patch levels is approximately 4.8 mm while the distance b between the second and third patch levels is approximately 16.1 mm. In this implementation, the distance c between the first patch level and the ground plane is 11.4 mm. Thus, for this implementation, the distance b is approximately 4-5 times the distance a while distance c is approximately 2-3 times the distance a.

To feed the signal to the antenna element, a slot 60 in the ground plane may be used to slot couple the antenna to a feed network. In the embodiment illustrated in FIG. 1, a cross-slot 60 in the ground plane 50 is used along with a metal cavity behind the ground plane (see FIG. 1A for the cavity). In one implementation, the cross-slot has a size of 3.7×57 mm such that each arm of the cross-slot is 3.7 mm in width and 57 mm in length. The cross-slot 60 is positioned directly under the antenna element 10.

Figure 1A:
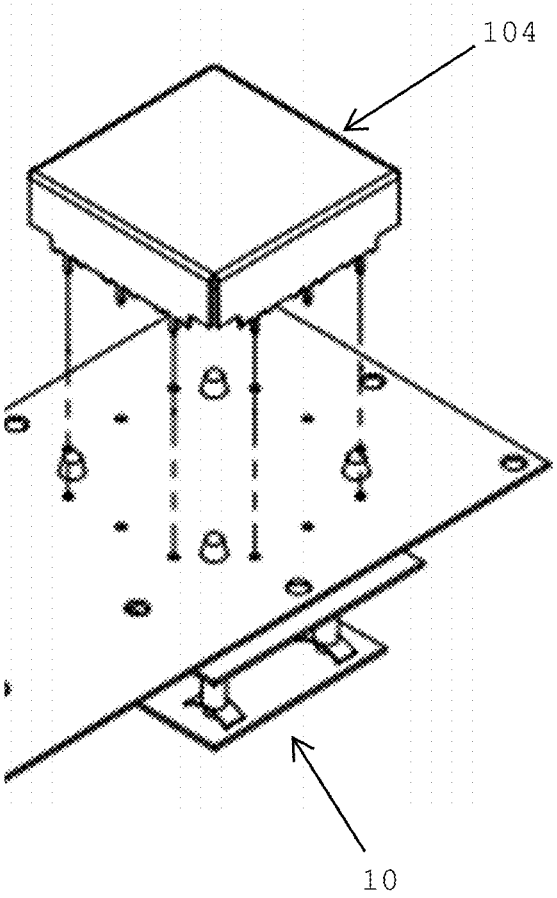
FIG. 1A is a bottom view of ground plane illustrating the cavity for the antenna element in FIG. 1.

Referring to FIG. 1A, a bottom view of the ground plane 50 is illustrated. From the Figure, one can see the antenna element 10 and a cavity 104. The cavity 104 is an empty metal box that, when mounted, is on the opposite side of the cross-slot 60. In the implementation in FIG. 1A, the cavity has a size of 40 mm×40 mm and is 12 mm in depth.

Figure 1B:
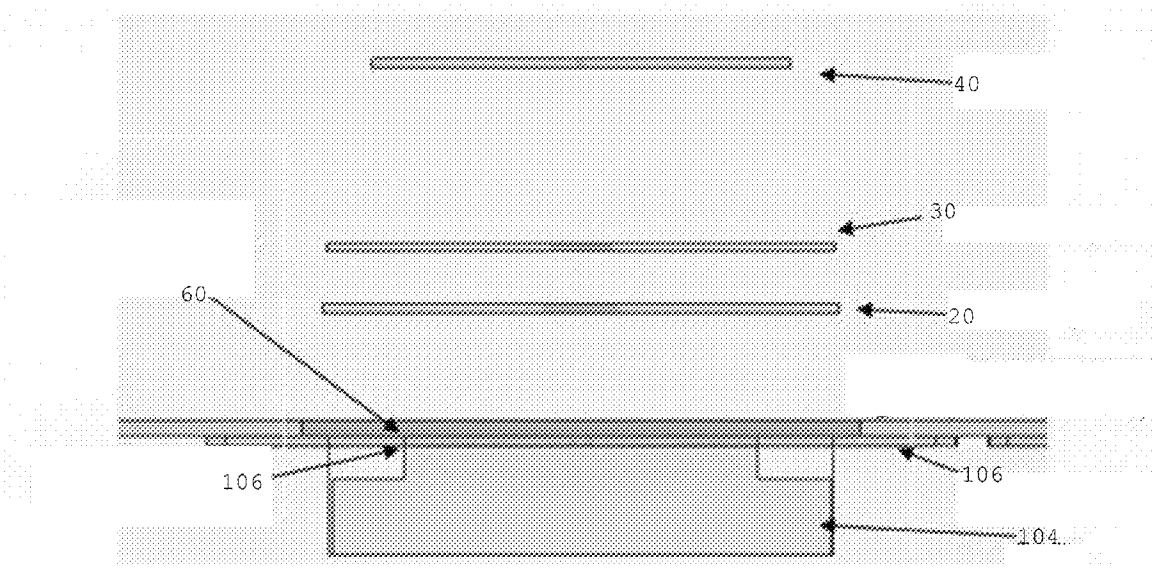
FIG. 1B is a side cut-away view of the antenna element and its surrounding structures to illustrate the relative positioning of the various components.

To better explain the structure of the antenna element 10 and the relative positioning of the ground plane 50, the cross-slot 60, and the cavity 104, FIG. 1B is a side cut-away view of the structure. As can be seen, the various patch levels of the antenna element 10 and the cavity 104 are on opposite sides of the ground plane 50. The cross-slot 60 is on the same side of the ground plane 50 as the antenna element 10 and is on the opposite side from the cavity 104. It should be noted that circuitry 106 is part of the signal feed and of the beamforming network. It should also be clear that the structural supports and spacers shown in FIG. 1 are not illustrated in FIG. 1B.

Returning to FIG. 1, when assembled, the antenna element uses three patches, each of which has a specific function. The first patch 20 on the first patch level operates as a drive patch, the patch 30 on the second patch level operates as a parasitic patch, while the patch 40 on the third patch level operates as a guide patch.

By introducing an additional patch with a relatively large distance between the second and third patch levels (as compared to the distance between the first and second patch levels), the ultra-wideband bandwidth and gain of the antenna element is significantly improved. Since the antenna element is for use in an antenna array, coupling between antenna elements is undesirable. To compensate for such cross-coupling, the antenna element may be surrounded by a conductive fence on the ground plane. Use of these techniques will also enhance isolation between dual polarizations in addition to the reduction in mutual coupling between antenna elements.

Figure 2:
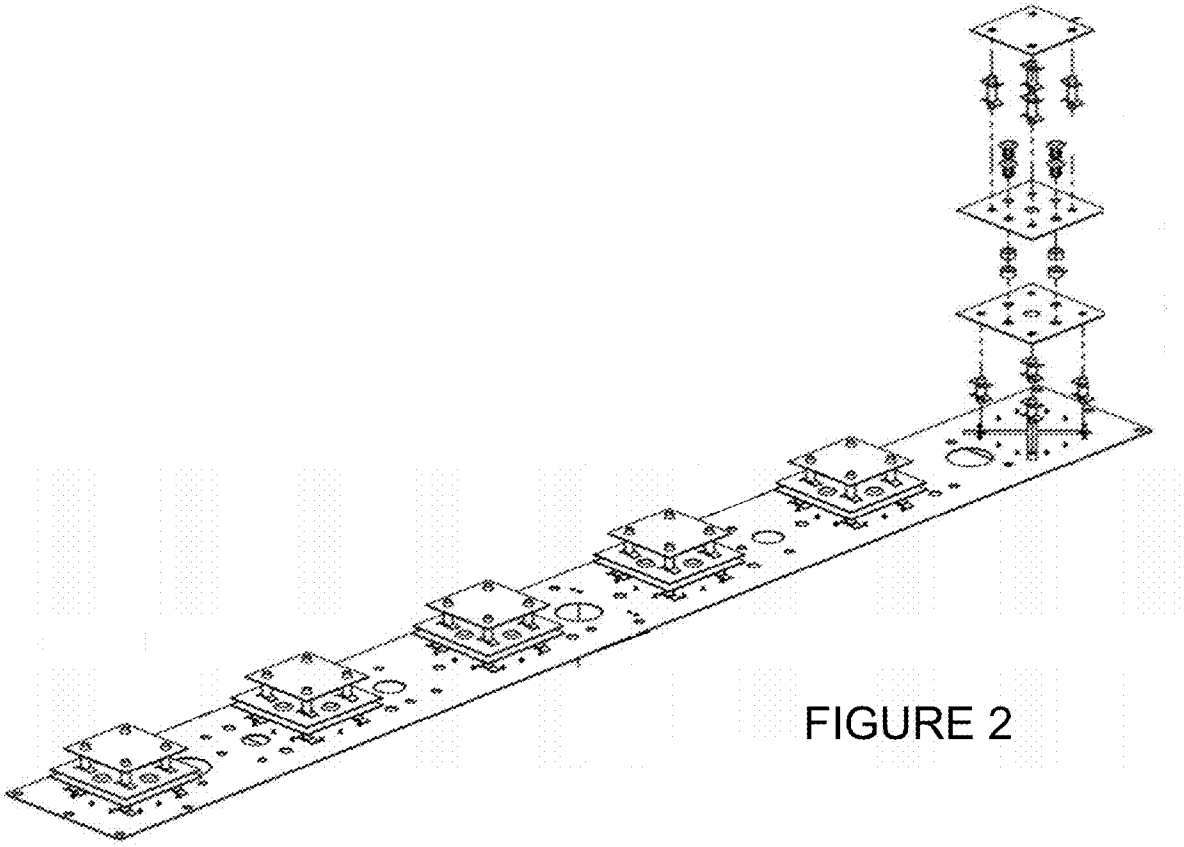
FIG. 2 is an isometric view of a blade array using the antenna element illustrated in FIG. 1.
Figure 2A:
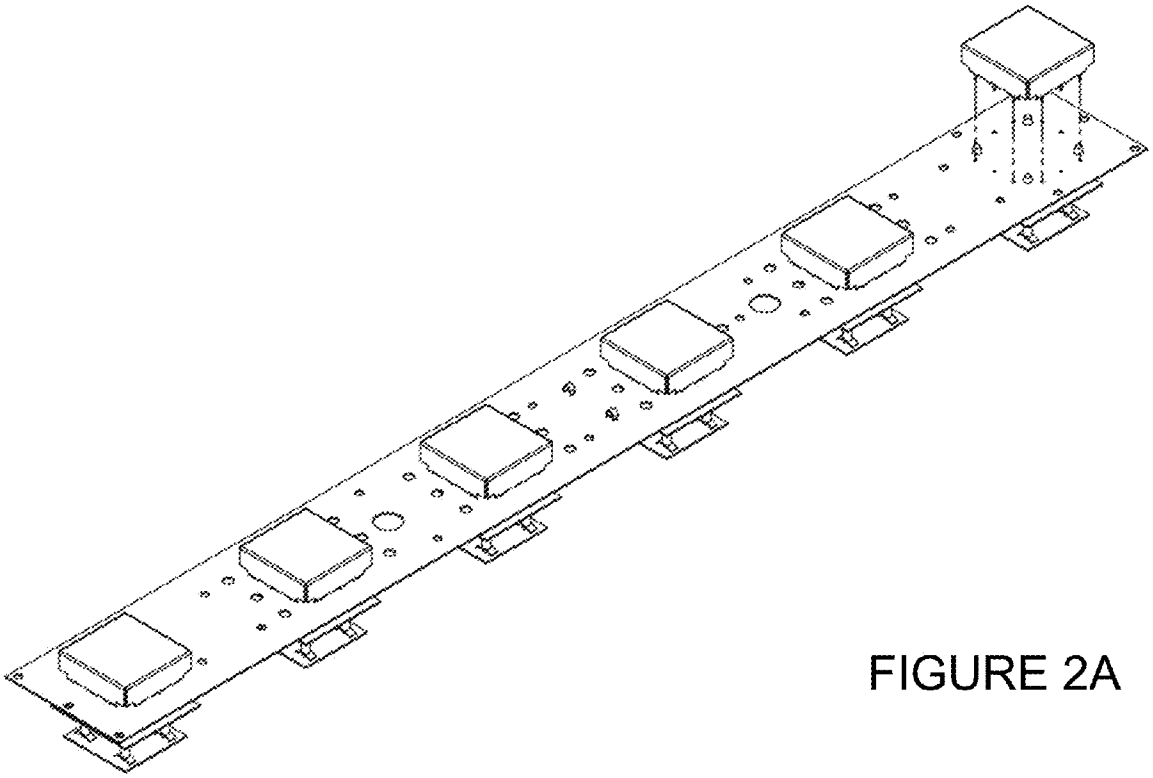
FIG. 2A is a bottom view of the blade array in FIG. 2.
Figure 4:
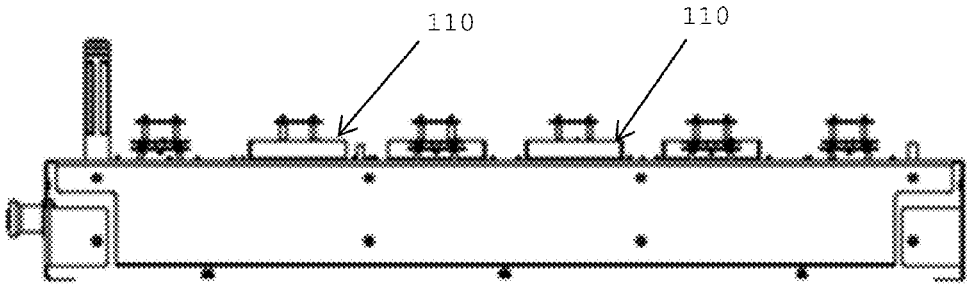
FIG. 4 is a side view of the antenna array illustrated in FIG. 3.

In one implementation, the antenna element illustrated in FIG. 1 is placed in a linear or blade array of six antenna elements (see FIG. 2). A bottom view of the blade array in FIG. 2 is illustrated in FIG. 2A. Referring to FIG. 3, top view of a planar array of antenna elements using the antenna element of the present invention is illustrated. As can be seen, the planar array has six rows and 14 columns with a number of the antenna elements being surrounded by a fence. With the exception of the first and last rows, each row has fenced antenna elements to result in a checkerboard pattern of fenced antenna elements for the whole array. Referring to FIG. 4, a side view of the antenna array in FIG. 3 is illustrated. The fences 110 can be clearly seen in the figure. In addition to the presence of the fences in FIG. 4, the difference in distance between the first and second patch levels and between the second and third patch levels can also be clearly seen.

Figure 5:
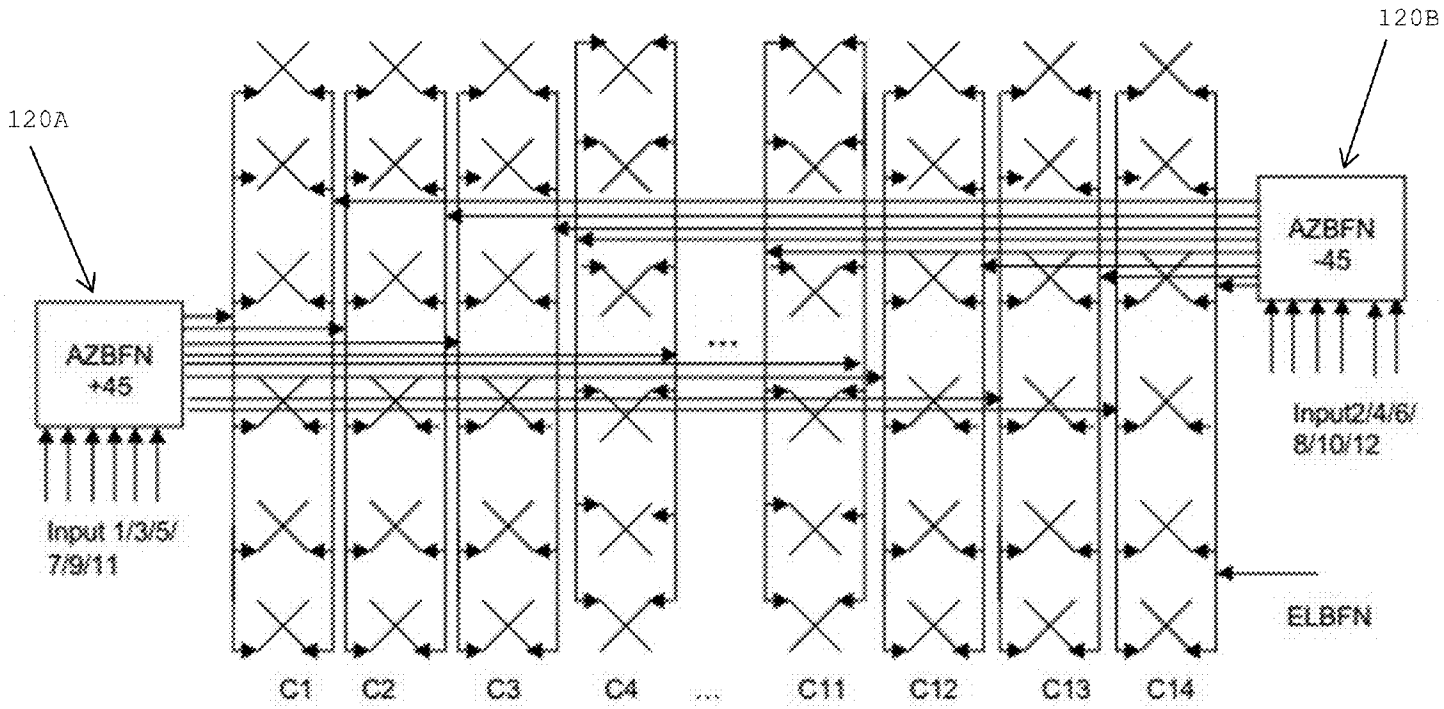
FIG. 5 is a plan view of the antenna array in FIG. 4 showing how the azimuth beamforming networks feed the array.

The planar array of antenna elements illustrated in FIGS. 3 and 4 can be used to produce dual polarized six beam patterns using the schema illustrated in FIG. 5. As can be seen from FIG. 5, azimuth beamforming networks (AZBFN) 120A and 120B are used to feed the 6 row and 14 column array. One AZBFN 120A is polarized by +45 degrees while the other AZBFN is polarized by −45 degrees. The planar array in FIG. 5 is also feed by an elevation beam forming network (ELBFN).

Figure 6:
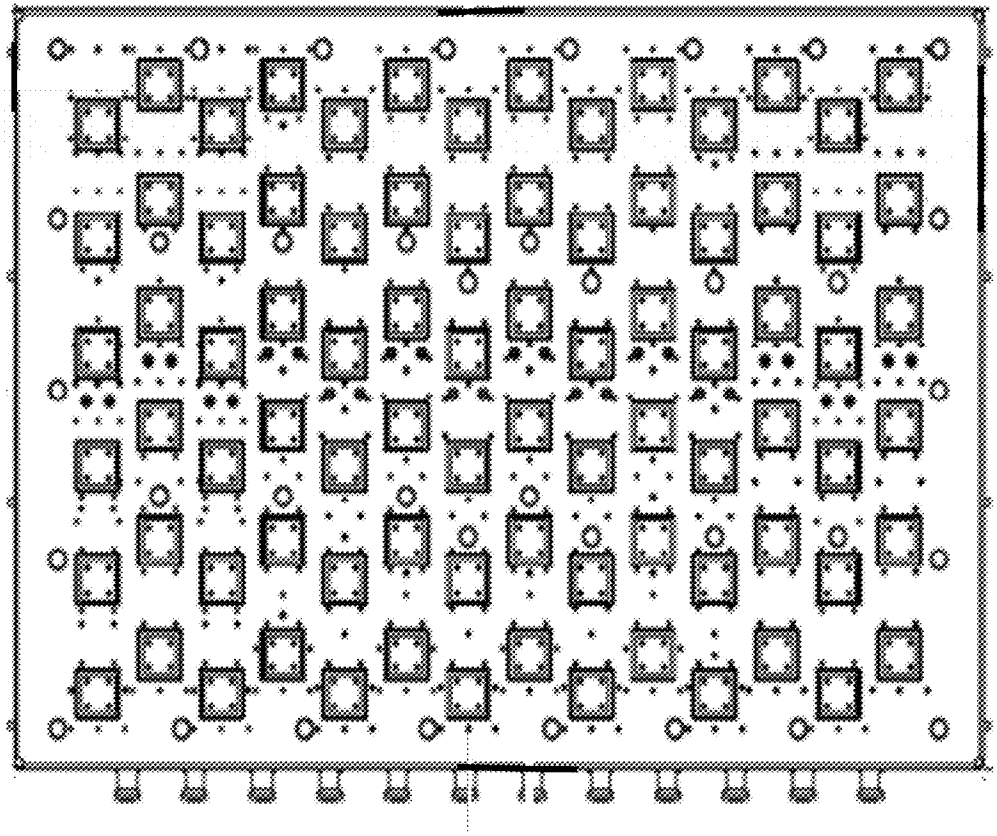
FIG. 6 illustrates a variant of the antenna array in FIG. 4 with the columns staggered.
Figure 7:
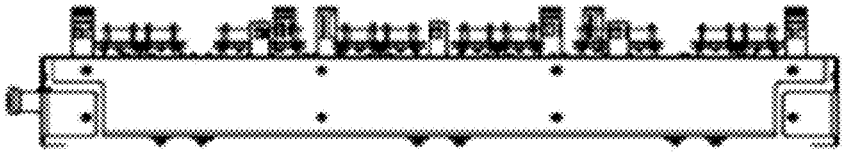
FIG. 7 is a side view of the antenna array shown in FIG. 6.

As a variant of the planar array of antenna elements, FIGS. 6 and 7 illustrate a similar array. As can be seen from FIG. 6, this alternative configuration of the planar array also has six rows and fourteen columns. However, this variant does not use fences around the antenna elements and the antenna elements are staggered such that each column aligns not with its immediate neighbor column but with a column two columns over. Thus, every other column aligns with each other. The staggered nature of the antenna elements has a similar effect to the use of conductive fences around the antenna elements. FIG. 7 is a side view of the antenna array in FIG. 6.

To determine the staggering distance used in the array in FIGS. 6 and 7, the desired side lobe level can be determinative. As an example, using a 40 mm staggering distance in the antenna array in FIG. 3 achieves a 2/5 dB elevation sidelobe level/grating lobe improvement. Other distances are, of course, possible.

Figure 8:
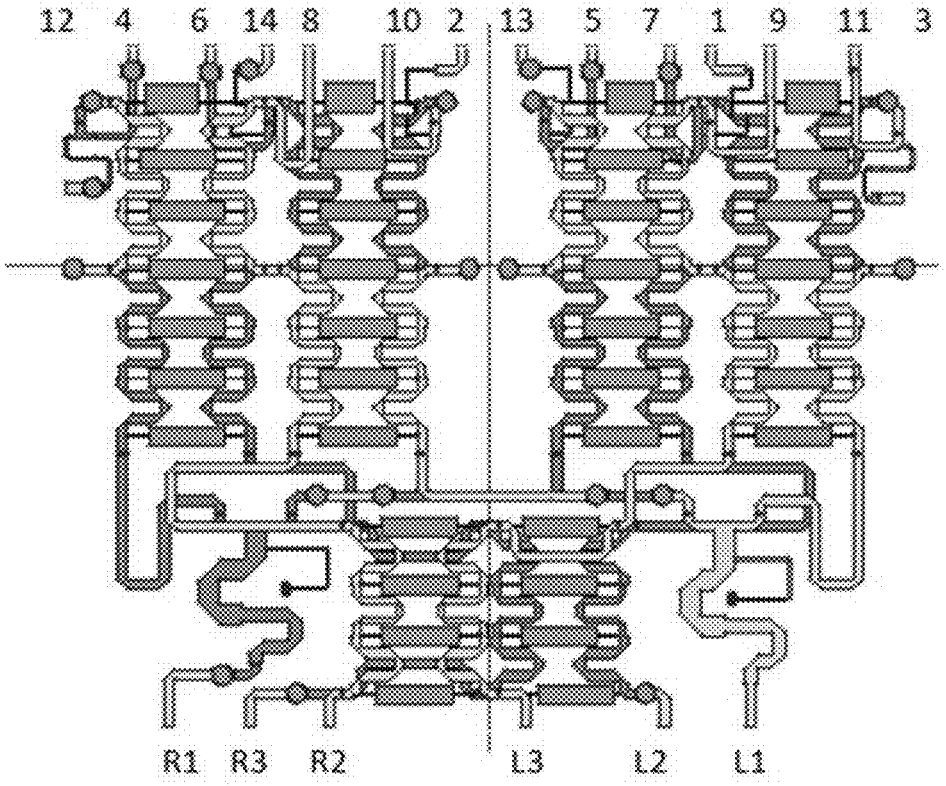
FIG. 8 illustrates a sample azimuth beamforming network as used in one implementation of the invention.

Regarding the azimuth beamforming network, such a compact multilayer AZBFN with 6 inputs (i.e., R1/2/3 and L1/2/3) and 14 outputs is illustrated in FIG. 8. It should be noted that the figure illustrates a multilayer structure with the grey shapes representing copper tracks at the top layer, yellow shapes representing via holes and slots at the middle layer, and green shapes representing copper tracks at the bottom layer.

It should also be clear that although the implementation illustrated uses a pair of AZBFN networks, implementations using a single AZBFN network are possible. As an example, a single AZBFN would be used for a single polarization array (vertical or horizontal polarization) using a single polarization element. For cellular communications and for the implementation illustrated in the Figures, dual polarization is used for diversity gain.

Figure 9:
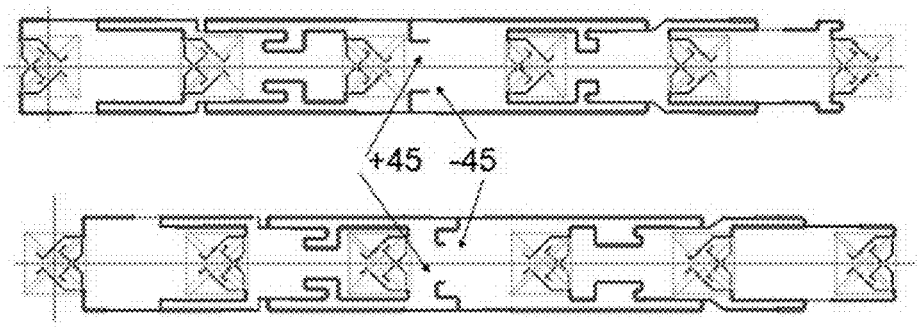
FIG. 9 illustrates a sample elevation beamforming network as used in one implementation of the invention.

For the elevation beamforming network (ELBFN), such a network is illustrated in FIG. 9. The network in FIG. 9 has two inputs (+45 and −45) with the top network being the normal phase ELBFN and the bottom network being the anti-phase ELBFN.

Figure 10:
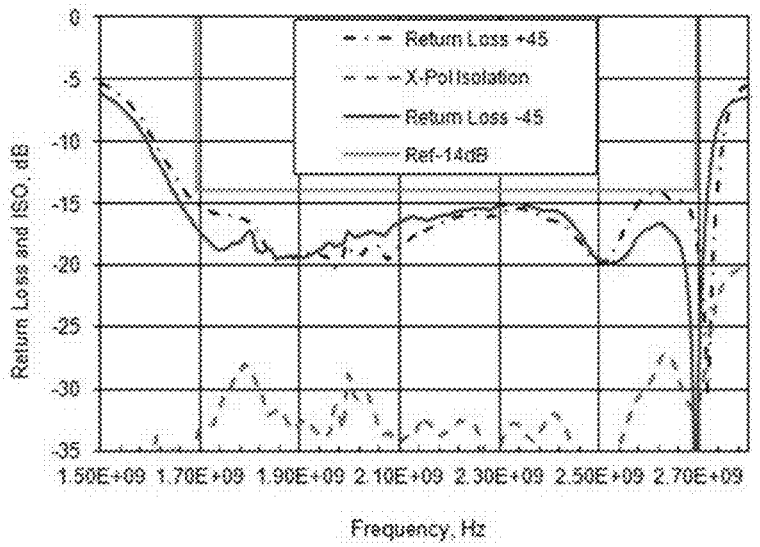
FIG. 10 illustrates the measured vector network analyzer results for the antenna element illustrated in FIG. 1.
Figure 11:
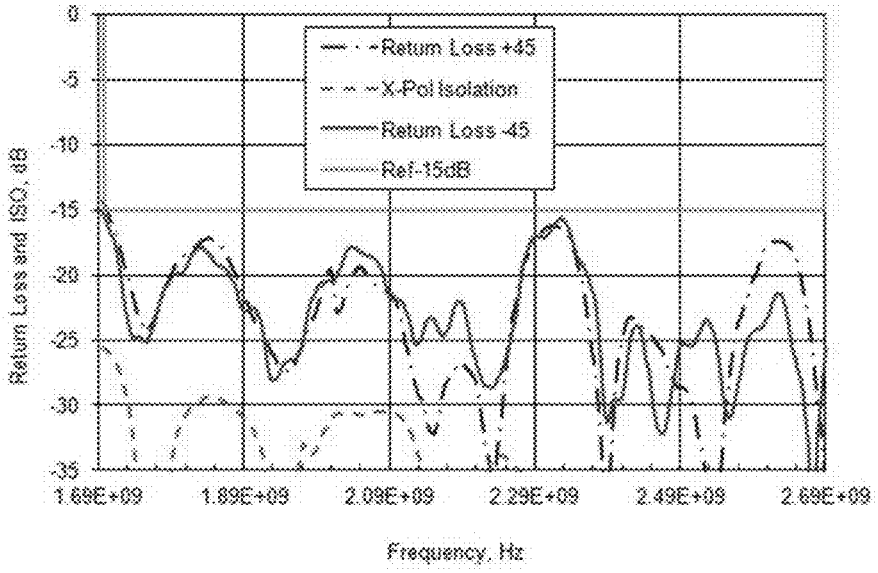
FIG. 11 illustrates the measured vector network analyzer results for the blade array illustrated in FIG. 2.

FIG. 10 show the measured vector network analyzer results for the antenna element illustrated in FIG. 1 with a 14 dB return loss and with 27 dB cross-polarization isolation. FIG. 11 shows the measured vector network analyzer results for the linear array in FIG. 2 with a 15 dB return loss and with 25 dB cross-polarization isolation.

Figure 12:
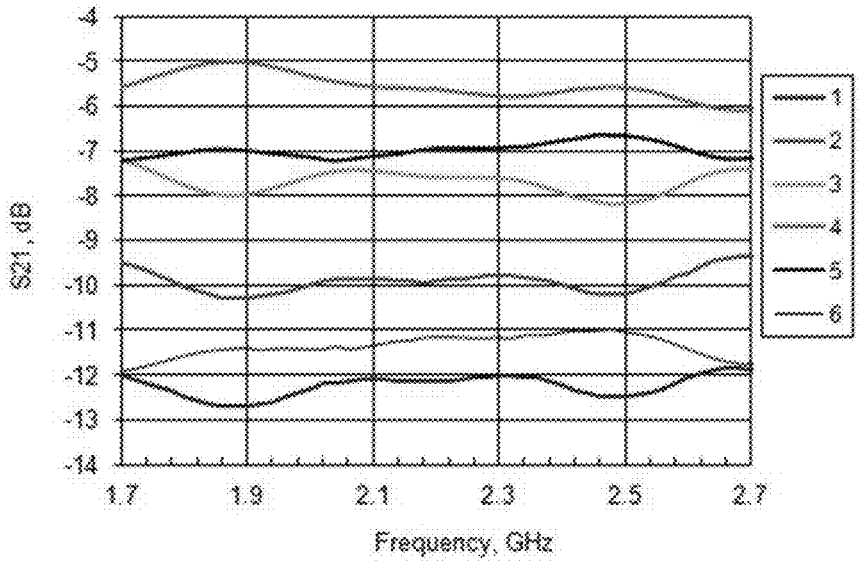
FIGS. 12 and 13 show vector network analyzer results for the elevation beamforming network in FIG. 9 and for the azimuth beamforming network in FIG. 8.
Figure 13:
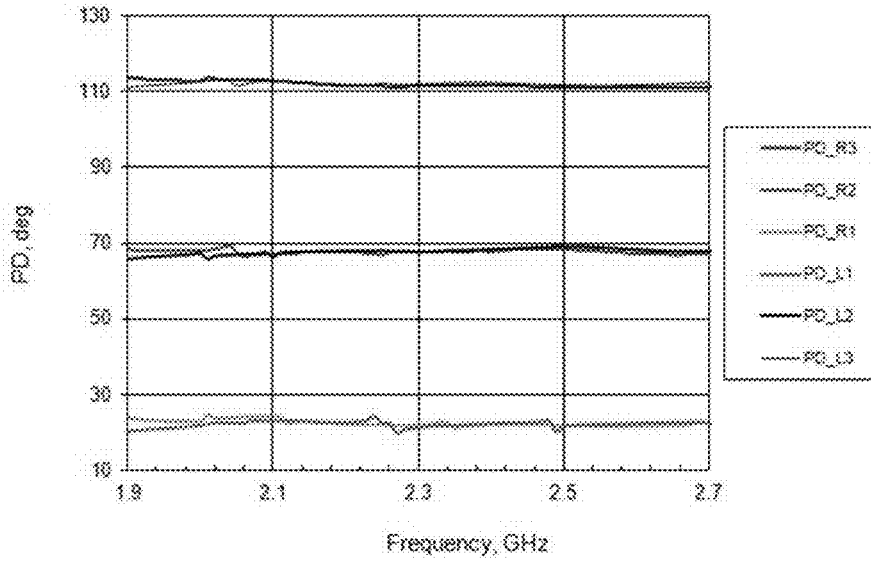

Regarding the azimuth beamforming network and the elevation beamforming network illustrated in FIGS. 8 and 9, FIGS. 12 and 13 illustrate measured and simulated vector network analyzer results for these networks. FIG. 12 shows the measured amplitude response in dB for various frequencies for the elevation beamforming network. FIG. 13 shows the simulated phase difference response for various frequencies for the azimuth beamforming network.

Figure 14:
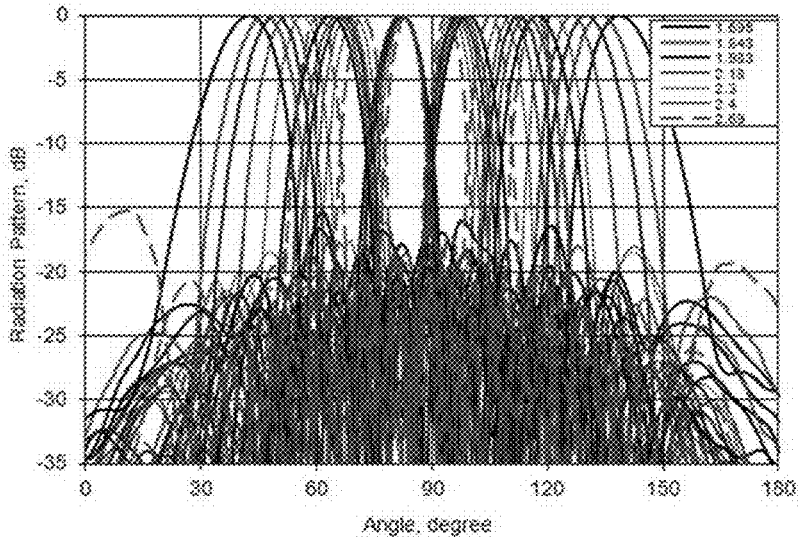
FIGS. 14 and 15 show the radiation patterns for the antenna array illustrated in FIGS. 3 and 4.
Figure 15:
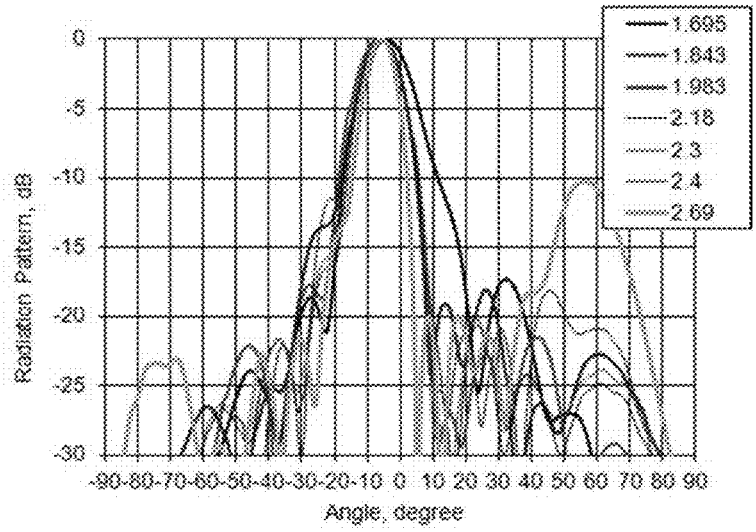

For the antenna array in FIGS. 3 and 4, radiation patterns for this antenna array are shown in FIGS. 14 and 15. FIG. 14 show the azimuth patterns for various frequencies (from 1.696 GHz to 2.69 GHz) with a 6 degree down-tilt angle. FIG. 15 shows the elevation patterns for the various frequencies as well.

Figure 18:
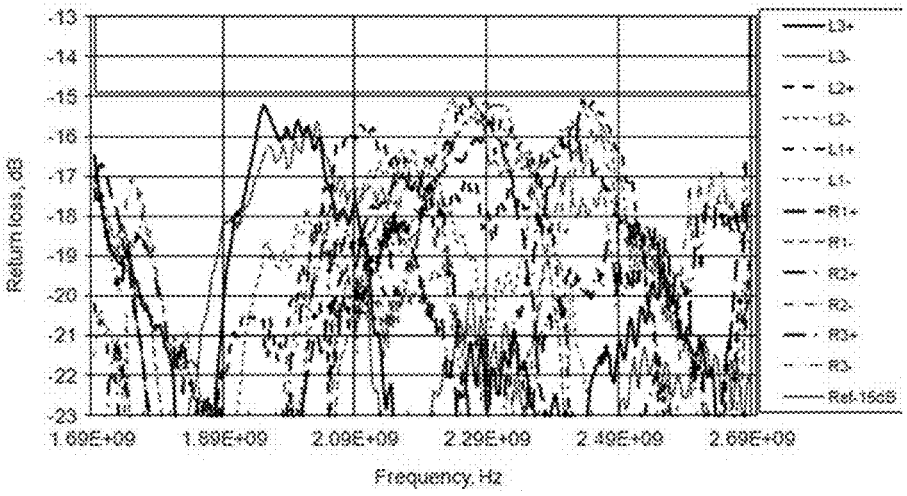
FIGS. 18 and 19 show vector network analyzer (VNA) results for the antenna array illustrated in FIGS. 3 and 4.
Figure 19:
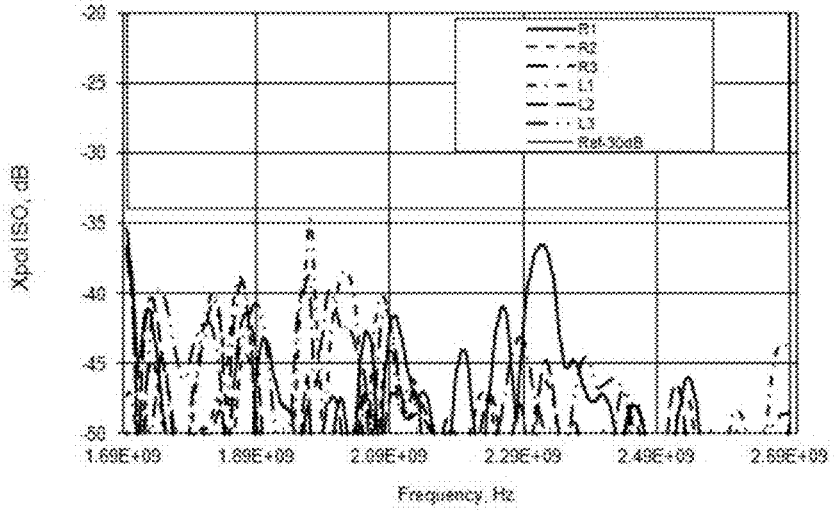

For the same planar array in FIGS. 3 and 4, the measured vector network analyzer results are illustrated in FIGS. 18 and 19 with a 15 dB return loss and with a 34 dB cross-polarization isolation.

Figure 16:
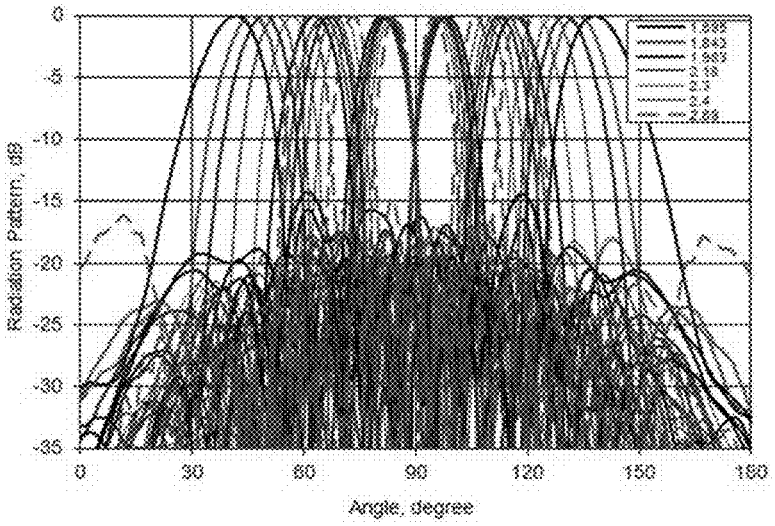
FIGS. 16 and 17 show the radiation patterns for the antenna array illustrated in FIGS. 6 and 7.
Figure 17:
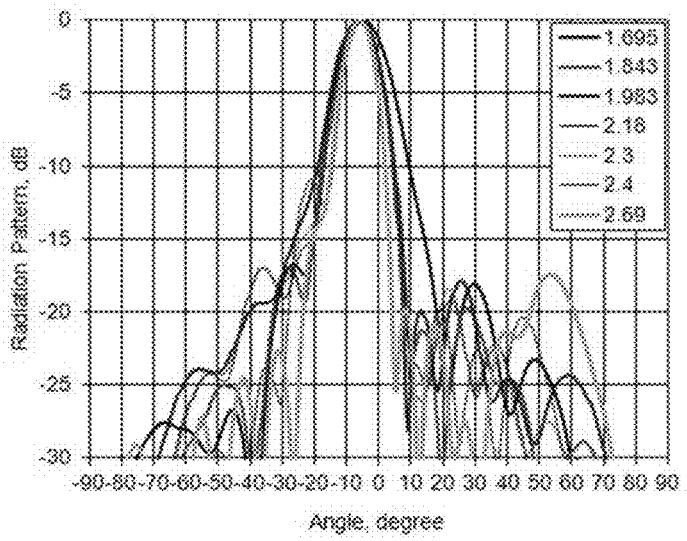

For the antenna array variant in FIGS. 6 and 7, the measured performance results are illustrated in FIGS. 16 and 17. Similar to FIGS. 14 and 15, FIG. 16 shows the azimuth patterns for various frequencies ranging from 1.69 GHz to 2.69 GHz with a 6 degree down-tilt angle. FIG. 17 shows the elevation patterns for the same frequencies.

It should be noted that the spacings between the antenna elements in the antenna arrays may be selected carefully based on the desired frequency range. This can be done to balance between the grating lobe at the high end of the frequency band and the multi-coupling between the antenna elements. In one implementation, the azimuth and elevation spacings were $0.4\lambda_1/0.65\lambda_2$, and $0.65\lambda_1/\lambda_2$ (where $\lambda_1$ and $\lambda_2$ are the free space wavelengths of the two ends of the frequency band).

It should also be noted that while the antenna arrays illustrated in the figures use 6 rows and 14 columns, other configurations are possible. As an example, the number of columns may be reduced to achieve beam patterns with less cross over points. Thus, instead of a 10 dB cross-over point for the 6 beam 14 column antenna array, a 6 dB cross-over point can be achieved using a 6 beam 10 column antenna array. As well, instead of a 6 beam array, other numbers of beams are possible. As an example, by replacing the azimuth beamforming network, other numbers of beams can be produced. In one implementation, if a 9×20 azimuth beamforming network is used instead of the 6×14 azimuth beamforming network, a 9 beam array can be produced.

A person understanding this invention may now conceive of alternative structures and embodiments or variations of the above all of which are intended to fall within the scope of the invention as defined in the claims that follow.

We claim:

1. A wideband single antenna element comprising: a first conductive patch on a first plane; a second conductive patch on a second plane, said second patch being spaced apart from said first patch; a third conductive patch on a third plane, said third patch being spaced apart from said second patch such that said second patch is between said first patch and said third patch; wherein said first patch is spaced apart from a ground plane such that said first patch is between said ground plane and said second patch and where said first conductive patch on said first plane is spaced apart from said second conductive patch on said second plane at a first distance and where said second conductive patch on said second plane is spaced apart from said third conductive patch on said third plane at a second distance, the second distance being a larger spacing than said first distance: and said antenna element receives a signal feed by way of a slot in said ground plane; said first, second, and third planes are parallel to each other and to said ground plane.

2. An antenna element according to claim 1, wherein a first spacing between said first patch and said second patch is different from a second spacing between said second patch and said third patch.

3. An antenna element according to claim 2, wherein said second spacing is greater in value than said first spacing.

4. An antenna element according to claim 2, wherein a third spacing between said first patch and said ground plane is different from said second spacing.

5. An antenna element according to claim 1, wherein at least one of said first conductive patch, second conductive patch, and third conductive patch is circular in shape.

6. An antenna element according to claim 1, wherein at least one of said first patch, second patch, and third patch is square in shape with an inner circular hole.

7. An antenna element according to claim 1, wherein at least one of said first patch, said second patch, and said third patch is deposited on a substrate.

8. An antenna element according to claim 1, wherein said antenna element is surrounded by a conductive fence to thereby electrically isolate said antenna element from other antenna elements in an antenna array.

9. An antenna element according to claim 8, wherein said conductive fence above the ground plane is square or rectangular in shape.

10. An antenna element according to claim 1, further comprising a square metal cavity with three pins on each side, said first patch being on a first side of ground plane and said cavity being on a second side of said ground plane, said first side being opposite said second side.

11. An antenna element according to claim 1, wherein said slot is a cross-slot having a dog-bone shape.

12. An antenna array comprising a plurality of wideband single antenna element comprising: a plurality of wideband single band antenna elements, at least one of said antenna elements comprising: a first conductive patch on a first plane; a second conductive patch on a second plane, said second patch being spaced apart from said first patch; a third conductive patch on a third plane, said third patch being spaced apart from said second patch such that said second patch is between said first patch and said third patch; wherein said first patch is spaced apart from a ground plane such that said first patch is between said ground plane and said second patch, and where said first conductive patch on said first plane is spaced apart from said second conductive patch on said second plane at a first distance and where said second conductive patch on said second plane is spaced apart from said third conductive patch on said third plane at a second distance, the second distance being a larger spacing than said first distance; and said antenna element receives a signal feed by way of a slot in said ground plane; said first, second, and third planes are parallel to each other and to said ground plane.

13. An antenna array according to claim 12, wherein said array comprises six rows and fourteen columns of antenna elements.

14. An antenna array according to claim 12, wherein said antenna elements are arranged in a right angled grid.

15. An antenna array according to claim 12, wherein said antenna elements are arranged in columns.

16. An antenna array according to claim 15, wherein each column aligns with every other column.

17. An antenna array according to claim 12, wherein at least one of said antenna elements is surrounded by a conductive fence.

18. An antenna array according to claim 12, wherein said antenna array is fed by at least one azimuth beamforming network.

19. An antenna array according to claim 18, wherein said at least one azimuth beamforming network comprises a first azimuth beamforming network and a second azimuth beamforming network, said first azimuth beamforming network having a polarization which is opposite to a polarization of said second azimuth beamforming network.

* * * * *